US005488989A

United States Patent [19]

Leising et al.

[11] Patent Number: 5,488,989

[45] Date of Patent: Feb. 6, 1996

[54] WHIPSTOCK ORIENTATION METHOD AND SYSTEM

[75] Inventors: Larry J. Leising, Sugar Land; Denis Doremus, Houston, both of Tex.

[73] Assignee: Dowell, a division of Schlumberger Technology Corporation, Houston, Tex.

[21] Appl. No.: 252,899

[22] Filed: Jun. 2, 1994

[51] Int. Cl.[6] ..... E21B 7/08; E21B 23/00

[52] U.S. Cl. ..... 166/255.3; 166/117.6; 166/215

[58] Field of Search ..... 166/255, 117.5, 166/117.6, 211, 215

[56] References Cited

U.S. PATENT DOCUMENTS

| | | | |
|---|---|---|---|
| 4,304,299 | 12/1981 | Holland et al. | 166/255 |
| 4,397,355 | 8/1983 | McLamore | 166/117.6 X |
| 5,232,058 | 8/1993 | Morin et al. | 175/74 X |
| 5,287,921 | 2/1994 | Blount et al. | 166/117.6 |

FOREIGN PATENT DOCUMENTS

| | | | |
|---|---|---|---|
| 2248079 | 3/1992 | United Kingdom | 166/117.6 |

*Primary Examiner*—Terry Lee Melius

*Attorney, Agent, or Firm*—Henry N. Garrana; John H. Bouchard; John E. Vick, Jr.

[57] ABSTRACT

A deflecting tool or whipstock is oriented and anchored in a well casing during a single trip of a running string so that a window can be formed in the wall of the casing at a selected azimuth. The angular orientation of the deflecting tool is measured, and signals representative thereof are transmitted to the surface. When the desired orientation is obtained, the anchor is actuated to prevent movement of the deflecting tool, and the orientation adjusting and measurement and transmission tools are released from the whipstock and removed from the casing by withdrawing the running string which preferably is coiled tubing. Then a downhole motor and milling bit are run into the casing on coiled tubing and operated to form a window through the wall thereof opposite the deflection surface of the whipstock so that a new borehole can be drilled outside the casing.

18 Claims, 3 Drawing Sheets

FIG. 1
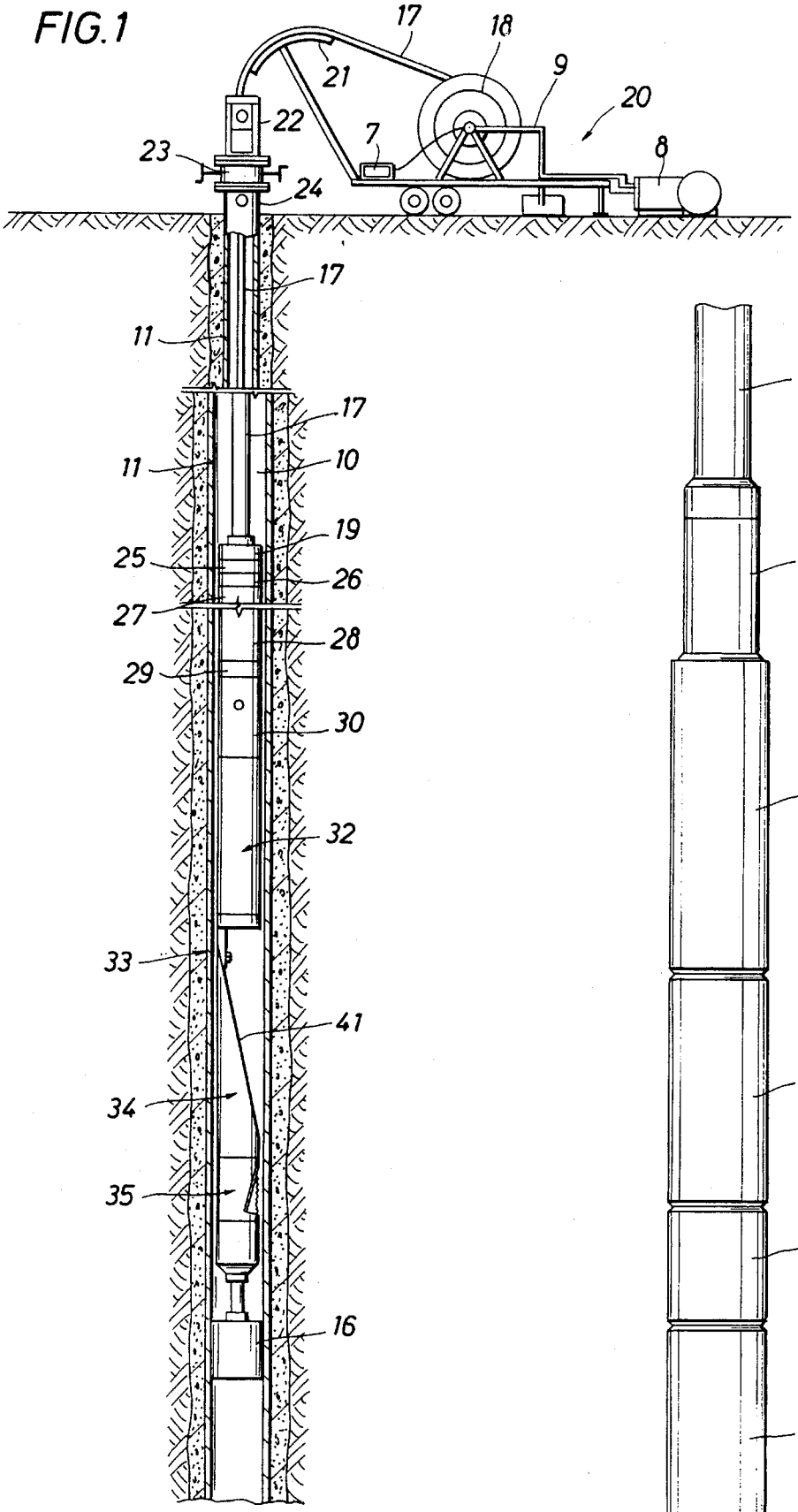
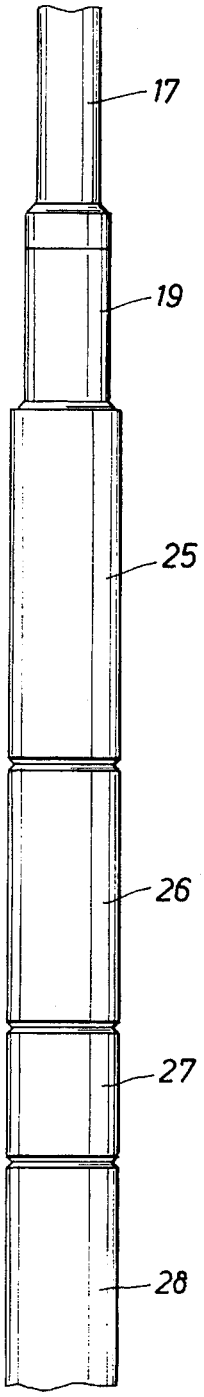
FIG. 2A

WHIPSTOCK ORIENTATION METHOD AND SYSTEM

FIELD OF THE INVENTION

This invention relates generally to methods and tools for forming a window at a certain azimuth through the wall of a well casing so that a new borehole can be drilled outside the cased borehole, and particularly to new and improved methods and tools of the type described where a deflection tool or whipstock can be oriented and anchored in the casing in a single trip of a running string into the well.

BACKGROUND OF THE INVENTION

In order to drill a new borehole that extends outside an existing cased wellbore in order to side track junk or drill toward another production target, the usual practice is to use a work string to run and set an anchored whipstock. If desired, a length of the casing where the whipstock is to be set is filled with cement, and a downhole motor and bit are used to drill a hole that deviates over to one side of the casing. After a whipstock has been set in the cemented region, a drill string and milling bits are used to cut out the window so that a new borehole that extends through the window can be drilled outside the casing. The anchor provides a platform that prevents downward movement of the whipstock whose deflection face is oriented at a desired azimuth prior to setting the anchor by rotating the work string at the surface. Then a starter mill on the lower end of the work string is used to cut an initial window through the casing wall opposite the deflection surface, and then the work string and starter mill are removed from the wellbore to allow a drill string having a window mill to be run in and rotated to enlarge the size of the window. Still another trip of the drill string typically is used to run a different type of window mill before the window through the side of the casing has been satisfactorily formed. This procedure requires multiple round trips of a running string to accomplish the desired objective, and thus is a time consuming and expensive operation. Moreover the reliability of prior systems in properly orienting the anchor so that the whipstock will be properly positioned has been less than desirable.

Such prior systems and tools have generally used a running string of tubing or drill pipe having individual joints or stands that must be threaded end-to-end as the tools are run into the well and then unthreaded as the tools are removed therefrom. Hereagain the procedure has been time consuming and expensive, particularly since multiple runs of the string have been required.

An object of the present invention is to provide new and improved methods and tool combinations for anchoring and orienting a whipstock in a well casing on a single trip of a running string into and out of the casing, thereby obviating the foregoing problems and disadvantages of prior systems.

Another object of the present invention is to provide new and improved methods and tool systems wherein a whipstock is oriented and anchored in a single trip of a running string and where orientation data is measured and transmitted to the surface substantially in real time to optimize setting reliability.

Still another object of the present invention is to provide new and improved methods and tools of the type described that are run on coiled tubing to provide significant overall cost savings for such operations.

SUMMARY OF THE INVENTION

The above and other objects are attained in accordance with the concepts of the present invention through the provision of a combination of tool components including an anchor having normally retracted gripping means that automatically shift outward to grip the casing wall when triggered by engagement with an obstruction in the well bore such as a bridge plug, and a whipstock having an inclined deflection surface rigidly attached to the upper end of the anchor. A data transmitting tool is releasably connected to the upper end of the whipstock and includes an orientation measuring instrument. An indexing tool that is connected above the transmitting tool can be operated to change the orientation of the whipstock until surface data from the transmitting tool indicates that proper orientation has been achieved. The anchor then is lowered against the obstruction to achieve automatic setting, whereupon the transmitter is released from the upper end of the whipstock. Then the transmitter, indexing tool, and running string can be removed from the well so that a suitable milling bit and downhole motor can be run in and operated to form a window through the wall of the casing opposite the inclined face of the whipstock so that a new borehole can be drilled outside the casing. The foregoing combination of tools preferably is run on coil tubing through which drill fluids are circulated to operate the transmitting tool and the indexing tool.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings in which:

FIG. 1 is a schematic view of a well operation where a whipstock is run, oriented and set on coil tubing;

FIGS. 2A–D are longitudinal sectional views, with some portions in side elevation, of the tool string shown in FIG. 1;

DETAILED DESCRIPTION OF A PREFERRED EMBODIMENT

Figure 2B:
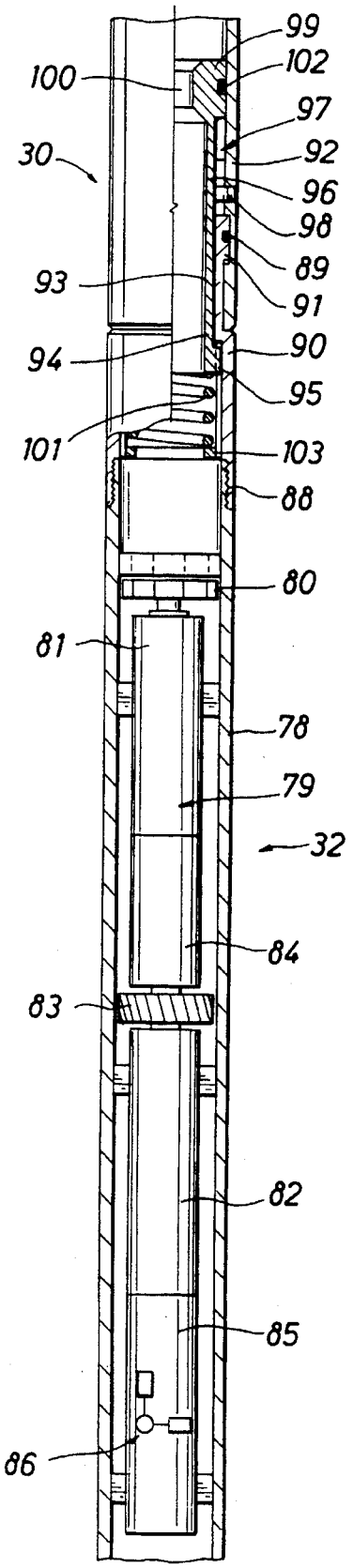

Referring initially to FIG. 1, a well bore 10 has been drilled into the earth and lined with a casing 11 which has been cemented in place. Although not shown as such in the drawings, the wellbore 10 usually is inclined with respect to the vertical so that it has a low side and a high side. For any one of a number of reasons it has become necessary and desirable to drill a new borehole outside the casing 11, so that a window having a particular transverse size and length must be formed through the casing wall at a certain depth. It is generally desirable that the window have a selected azimuth or compass heading so that the new borehole will avoid intersection with nearby wells, or otherwise extend toward a planned target or have a certain trajectory.

To form a casing window in accordance with this invention, a bridge in the casing 11 is formed by setting a bridge plug 16 on a wireline, gas operated setting tool (not shown). The plug 16, which is well known, has normally retracted slips and packing which are expanded into gripping and sealing contact with the surrounding casing walls in response to actuation of the setting tool which automatically releases after the plug is fully set. A casing collar locator (CCL-not shown) is run above the setting tool for depth determination and control so that the precise depth of the top of the plug 16 with respect to the nearest casing collar is known. Alternatively a column of cement can be placed inside the casing, and a hole drilled in the cement which receives the whipstock and anchor as noted above. In some wells the tool string described below can be run through a lesser diameter production string of pipe and out into a larger diameter casing in which the plug or packer 16 is set or a cement column formed.

After the plug 16 has been set at the proper depth, a string of tools in accordance with this invention is lowered on a running string 17 which preferably is coiled tubing that is wound on the reel 18 of a unit 20. The coil tubing 17 passes over a guide 21 and into the top of an injector 22 that forces it into and out of the well under power. The tubing 17 goes through one or more blowout preventers 23 that are mounted on top of the wellhead 24 at the top of the casing 11. The inner end of the coiled tubing 17 is connected by pipes 9 to a mud pump 8 so that fluids can be circulated down the tubing for purposes to be described below. A downhole measurement display unit 7 can be connected to a pressure transducer, as shown, for the acquisition of data in the form of pressure pulses in the fluids inside the coiled tubing 17, or an electric wireline can be positioned inside the coiled tubing and brought out at the center of the reel 18 via suitable connectors. Since the tubing 17 is continuous throughout its length, the need to make up and break out numerous threaded joints is eliminated, with considerable savings in time and expense.

Attached to the lower end of the coil tubing 17 is a suitable connector 19, a backflow control valve 25, and a disconnect mechanism 26. An adapter 27 can provide a crossover to the upper end of a string of drill collars 28, which are optional, and the lower end of these collars is attached by another crossover 29 to an indexing tool 30. A measuring-while-drilling (MWD) tool 32 providing either mud pulse or wireline telemetry of data is attached to the lower end of the device 30 and is releasably connected by a shear release device 33 to the upper end of a whipstock 34 having an anchor assembly 35 on its lower end. Although further structural details of each of the components 30–35 will be set forth below, their respective general functions are as follows. The anchor 35 can be set to grip the casing 11 and prevent downward movement upon being triggered by engagement with the top of the bridge plug 16. When set the anchor 35 provides support for the whipstock 34 which has an inclined concave deflection surface 41 that guides a rotating milling bit and forces it outward as it forms a window through the wall of the casing 11 opposite the inclined surface.

The shear release device 33 includes a frangible element that is designed to shear off when a predetermined level of longitudinal force is applied thereto so that the MWD tool 32 and the indexing tool 30 can be retrieved from the well after the whipstock 34 and the anchor 35 have been oriented and set. The MWD tool 32 functions to transmit signals to the surface, for example in the form of pressure pulses in the mud stream being circulated down the coiled tubing 17. Although such pulses can represent any downhole measurement, in this case the measurement is the toolface angle of the deflection surface 41 of the whipstock 34. As used herein the terms "toolface" or "toolface angle" mean the angle as viewed from above between a reference radial line off the axis of the borehole that passes, for example, through the low side of the inclined borehole 10, and a similar radial line which extends at a right angle to the deflection surface 41. Thus toolface gives the general outward direction in which a bit will drill as it moves downward along the deflector surface 41. An instrument that can be used to measure toolface is an inclinometer package whose output signals are fed to a controller in the MWD tool 32 which varies the rotational speed of a rotary valve element or "siren" therein so that it interprets the mud flow in a certain way and generates pressure pulses that are representative of the inclinometer output signals. The pulses travel very quickly to the surface through the fluid in the coil tubing 17 where they are detected by a transducer, processed, and displayed and/or recorded so that the orientation of the whipstock 34 is available at the surface substantially in real time. As noted above, a wireline MWD tool also can be used.

The indexing tool 30 can take various forms such as a swivel coupling having an internal spring load indexing sleeve that is slidably splined to the lower member of the coupling. Often systems including an electrical motor and gear drive, or an electro-hydraulic device with a pump and gear drive also could be used. In the disclosed embodiment, a channel system such as a continuous jay-slot on the sleeve cooperates with a radial index pin on the upper coupling member causes the lower member to index through a selected angle as the sleeve shifts vertically. Vertical movement can be caused by temporarily increasing the flow rate through the coiled tubing 17. The disconnect 24 also can take various forms, and for example can include a shear release device that is disrupted to allow the coiled tubing 17 to be removed from the well in case the tools become stuck for any reason, so that conventional fishing tools can be run to catch and retrieve the stuck tools.

Figure 2C:
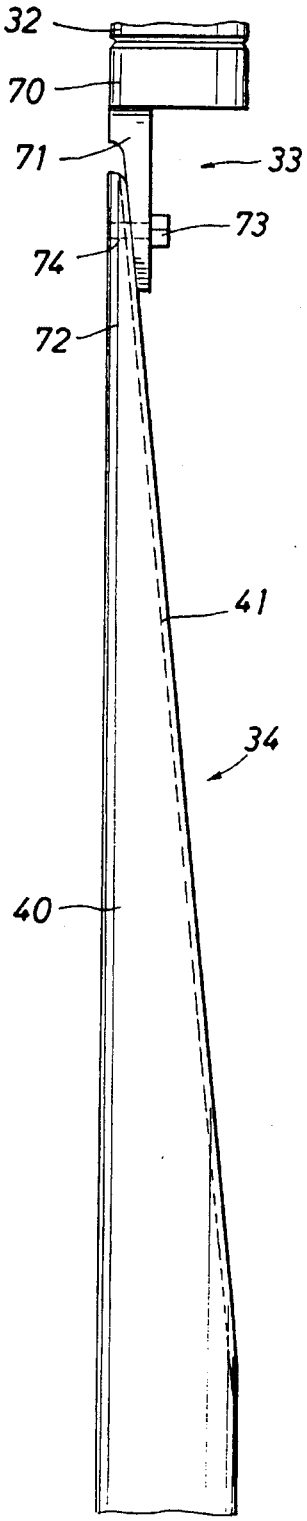

Turning now to FIGS. 2C and D for a detailed description of the whipstock and anchor assemblies 34, 35, the whipstock includes an elongated, generally cylindrical body 40 having a downwardly and outwardly inclined surface 41 which deflects a drill bit outward as it moves downwardly therealong. The inclination angle between the surface 41 and the longitudinal axis of the body 40 can be in the range of from about 1°–4° in a typical example. As shown by the phantom lines, the surface 41 can be concave in section so that a rotating mill tends to remain centered thereon. The bottom end of the body 40 is connected by a threaded pin 42 to a companion threaded box 43 on the upper end of the anchor 35, or these members can be integral. The anchor assembly 35 includes an expander member 44 having a flat surface 45 on one side that inclines downward and inward, and opposite facing L-shaped guide rails 46 are fixed along the sides of the surface 45. A slip member 47 having an inclined rear face 48 and an arcuate outer face 49 is slidably arranged on the surface 45, and has notched side edges that cooperate with the guide rails 46 to maintain longitudinal alignment. Downwardly facing serrations or teeth 50 on the outer face 49 of the slip member 47 are adapted to bite into and grip the wall of the casing 11 when shifted outward into engagement therewith by upward movement along the expander 44.

The lower end of the expander 44 is threaded at 51 to a hollow barrel 52 which has a cap 53 threaded to its lower end. A trip rod or bar 54 having an enlarged diameter shoe 55 on its lower end extends through a central opening 56 in the cap 53 and into the inside of the barrel 52 where a plunger plate 57 is fixed on its upper end. A compressed coil spring 58 reacts between the lower face 59 of the plate 57 and the upper face 60 of the cap 53. The spring 58 is normally compressed as shown, and is held compressed by a shear pin 61 that extends through radially aligned holes in the cap 53 and the rod 54. A setting pin 62 whose lower end is threaded into an offset bore on the plate 57 has an upper portion 63 that extends through a radially offset bore 64 in the lower end portion of the expander 44, and an upper end face 65 that engages a lower end surface 66 of the slip member 47. The pin 62 has an upwardly and outwardly inclined inner wall 65 having a taper that generally matches the taper on the expander surface 45.

When the shoe 55 engages an obstruction in the well bore, such as the bridge plug 16 (FIG. 1), and a predetermined amount of downward force is applied to the barrel 52, the rod pin 61 will shear and allow the spring 58 to exert upward force on the slip member 47. Such force shears a screw 67 which initially holds the slip member 47 retracted, and then expansion of the spring 58 drives the setting pin 62 relatively upward so that it pushes the slip member 47 upward along the expander surface 45 and thereby causes the slip member to extend. When the teeth 50 which preferably face downward grip the casing wall, the assembly 35 is anchored against downward movement in a manner such that downward force on the whipstock 34 and the expander 44 will cause additional outward pressure on the slip member 47 which tightens the setting thereof.

As shown at the top of FIG. 2C, the upper end of the whipstock body 40 is releasably coupled to the lower end of the MWD tool 32 by a shear release mechanism 33 which allows the tool string components above such mechanism and the coil tubing 17 to be removed from the well after the whipstock 34 has been oriented and set. The release mechanism 33 can include a sleeve 70 having a depending arm 71 on one side that is connected to the upper portion 72 of the whipstock body 40 by a shear stud 73 that extends through hole in an arm 71 and into a threaded bore 74. The stud 73 is designed to shear off when a downward or upward force of a certain magnitude is imposed thereon. When the stud 71 shears, the arm 71 and all components thereabove are free to be raised upward in the well bore, leaving the whipstock assembly 34 and the anchor assembly 35 in place.

As shown in FIG. 2B, the MWD tool 32 includes a tubular housing or collar 78 having a telemetry system 79 mounted therein. Where the tool 32 is a mud pulse system rather than wireline, the system 79 has a rotary valve element 80 on its upper end which creates pressure pulses in the stream of circulating drilling fluids being pumped downward therethrough. The operation of the valve 80 is modulated by a controller 81 in response to electrical signals from a cartridge 82. The flow of drilling fluid rotates a turbine 83 which drives a generator 84 that provides electrical power to the system. The pulses in the mud stream generated by the rotary valve 80 are detected at the surface, processed and displayed or recorded so that downhole measurements are available at the surface substantially in real time. Further details of the mud pulse telemetry system described above are disclosed in U.S. Pat. Nos. 4,100,528, 4,103,281 and 4,167,000 which are incorporated herein by reference.

The input signals to the cartridge 82 which enable practice of the present invention are from a package of sensors located in the measurement section 85 at the lower end of the tool 32. Such package includes three orthogonally mounted accelerometers 86 which measure components of the earth's gravity field and provide output signals representative thereof. The sensitive axes of the accelerometers are referenced to the inclined face 41 of the whipstock so that such signals define the toolface angle of such surface. The housing of the section 85 and the outer housing 78 of the MWD tool 32 preferably are made of a material such as monel steel to reduce interference. Although the MWD tool 32 shown has the inner assembly mounted in the housing 78 at the surface prior to running the tool string into the well 10, the inner assembly could be an electric wireline powered device that is seated in the housing. In this case the measurement data also is transmitted to the surface over the wireline.

Figure 3:
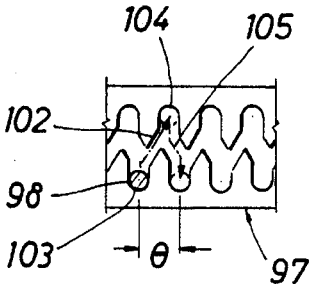
FIG. 3 is a developed plan view of the index slot and pin of the orienting tool.

The top of the MWD tool 32 is attached to the orienting mechanism 30 by threads 88. The mechanism 30 includes a swivel formed, for example, by a lower tubular housing 90 having an outwardly directed flange 91 on its upper end that fits into an internal annular recess on an upper tubular housing 92. A seal ring 89 prevents fluid leakage. An index sleeve 93 is slidably mounted within the housings 90 and 92 and has a lower section 94 with external splines 95 which mesh with splines in the lower housing 90 to couple the sleeve to the lower housing. An upper section 96 of the sleeve has a continuous jay-slot channel system 97 (FIG. 3) formed on its outer periphery which cooperates with a radial index pin 98 on the upper housing 92 to cause predetermined angular rotation of the lower housing 90 in response to longitudinal movement of the index sleeve 93. To effect such longitudinal movement, an annular head 99 on the upper end of the sleeve 93 has a reduced bore 100 through which drilling fluids pass during circulation, and a preloaded or compressed coil spring 101 biases the index sleeve 93 upward. A seal ring 102 prevents leakage past the outer periphery of the head 99. The spring 101 reacts between the lower end of the sleeve 93 and a retainer ring 103 on the housing 90. The size of the bore 100 and the rate of the spring 101 are selected such that at low fluid circulation rates the sleeve 93 remains in its upper position as shown, where the index pin 98 is in a lower one of the pockets 103. However when the circulation rate is increased to a normal flow rate, downward force on the head 99 overcomes the spring bias and causes the sleeve 93 to shift downward. On each downward movement, the pin 98 engages an inclined upper surface of channels 102 to cause the lower housing 90 to rotate through a selected angle that is defined by the angular separation between adjacent pockets 103, 104. Then when the flow rate is reduced, the spring 101 shifts the sleeve 93 back up to position the pin 98 in the next lower pocket 103. During upward sleeve movement, the sleeve 93 is indexed through an additional angle by engagement with an upwardly facing inclined surface 105. The total angle in response to the flow rate change cycle is the angle θ shown in FIG. 3. The angle θ can be any one of a range of low angles, and in a preferred embodiment is about 30°. As the sleeve 93 and the lower housing 90 rotate, so do all tools therebelow including the MWD tool 32, the whipstock 34 and the anchor 35.

The top of the orienting tool 30 is connected by an adapter 29 to the bottom joint of the string of drill collars 28 (FIG. 2A) which supply the weight necessary to operate the various shear release mechanisms. Alternatively the drill collars can be omitted and downward push of the coiled tubing 17 used to shear the release mechanisms. The upper end of the collars 28 is attached by an adapter 27 to a release mechanism 26 which is a safety feature that allows the coiled tubing 17 to be released from the collars and tool string in case they get stuck in the well for any reason. The mechanism 27 can take various forms, for example a tension operated system of concentric sleeves held by one or more shear pins. One of such sleeves can provide a ball seat so that a pump-down ball element can be used to allow a force due to pressure differential to be applied to the shear pins. Above the mechanism 26 is a back-flow control system 25 of flapper valves that automatically close when disconnect occurs to prevent back flow of fluid into the bottom end of the coil tubing 17. A conventional connector 19 which can include a grapple or set screw connector is used to attach the upper end of the valve system 25 to the lower end of the coiled tubing 17.

OPERATION

Figure 2D:
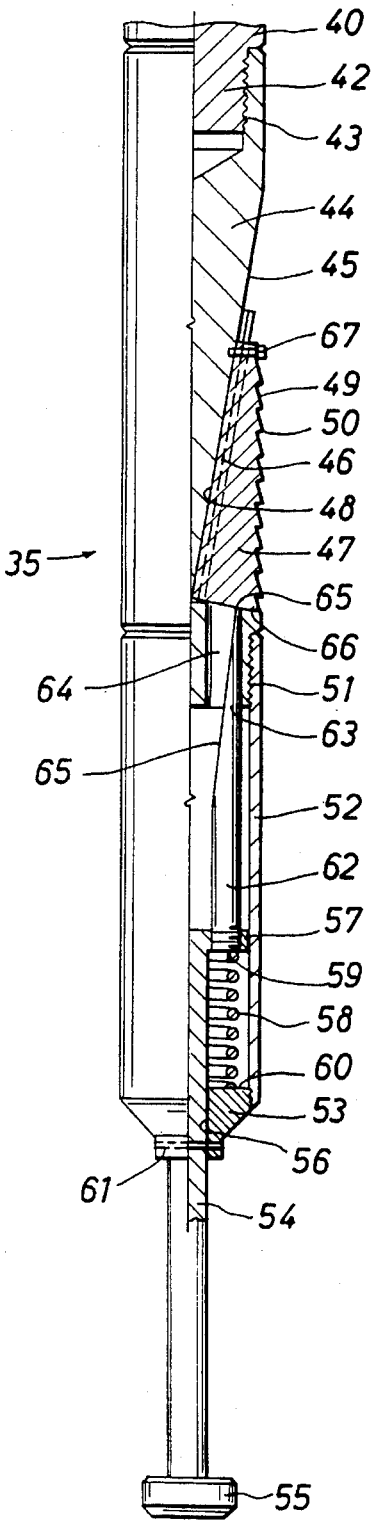

In operation, the bridge plug 16 shown in FIG. 1, a setting tool therefor, and a casing collar locator (CCL) are run into the well casing 11 on electric wireline and the bridge plug set about 5 feet above the casing collar that is nearest the desired kick-off point. In some cases a packer can be used. The CCL is used for precise depth control in setting the plug 16. Then the whipstock 34 shown in FIG. 2C is made up to the anchor assembly 35 of FIG. 2D, and the coil spring 58 in the lower portion of the barrel 52 is compressed by pulling outward on the rod 54 to allow the shear pin 61 put in place to retain the spring in compression. The MWD tool 32 shown in FIG. 2B then is attached to the top of the whipstock body 40 by the shear stud 73 and the arm 71 which depends from the sleeve 30, and the orienting tool 30 is threaded to the upper end of the MWD tool. The sensors 86 are referenced to the orientation of the deflection surface 41 of the whipstock 34. The drill collar string 28 is threaded to the top of the orienting tool 30, and the adapter 27, the disconnect device 26, the back flow valve 25 and coiled tubing connector 19 couple the collar string to the lower end of the coiled tubing 17.

The injector 22 is installed on the well head 24 at the surface and the string of tools is run into the well casing 11 on the outer end of the coiled tubing 17. From the point that the bottom foot 45 of the anchor 35 is about 35–40 feet above the bridge plug 16, the tool string is lowered very slowing until the foot tags the top of the plug. The coiled tubing depth indicator at the surface should be compared with the wireline depth reading made where the CCL was run. Then the tool string is raised until the foot 45 is about 2 ft. above the plug 16, and circulation is initiated to operate the MWD tool 32 and obtain a surface reading at the display 7 of the toolface of the whipstock deflection surface 41. To change the angle until it substantially corresponds with a selected azimuth, for example the azimuth of the high side of the borehole 10, the mud circulation rate is cycled as noted above to operate the orienting tool 30. As flow is increased the index sleeve 93 is rotated by the pin 98 through a small angle as it shifts down, and through an additional small angle as it is shifted upward by the spring 101 as flow rate is reduced. Sleeve rotation is coupled by the splines 95 to the lower housing 90 and thus to the MWD tool 32, the whipstock 34 and the anchor 35. As noted above, each increment of angular change can be about 30°, or less depending upon the angular spacing of the pockets 103. During each change in angular orientation, pressure pulses representing the measurements made by the inclinometers 86 in the MWD tool 32 are telemetered uphole. Flow rate change cycles are repeated until a selected azimuth of the deflection surface 41 is obtained, and then the tool string is lowered until the shoe 55 rests on the top of the bridge plug 16. Then about 4–5000 lbs. of downward force is applied to shear the pin 61 in the anchor 35 and thus trigger its setting. The slip element 47 is shifted upward and outward against the inner wall of the casing 11 by expansion of the spring 58 and upward movement of the rod 62. The force of the spring 58 also shears the slip retaining screw 67. The orientation of the whipstock face 41 can be reconfirmed after the anchor 35 is set by operating the MWD tool 32 and viewing the surface indication 7 provided by the mud pulse telemetry of signals.

Then a force of about 15,000 lbs is applied. Such force can be due either to an upward pull on the coil tubing 17 by the injector 22, or a downward push thereon by the injector. In either case the shear stud 73 (FIG. 2C) is disrupted so that the MWD tool 32 is released from the whipstock 34 and the anchor 35. Once this has occurred, the surface pump 8 can be shut down to stop circulation, and the remaining tools of the string pulled out of the well with the coiled tubing 17 and laid down.

Figure 4:
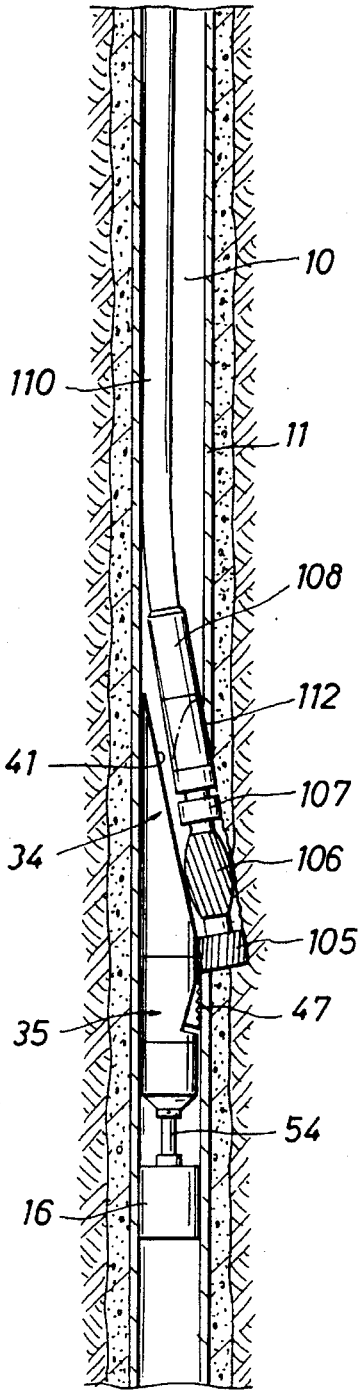
FIG. 4 is a schematic view showing a window being milled through the casing adjacent the inclined face of the oriented whipstock.

To mill an elongated window 112 or opening through the wall of the casing 11 at the level of the whipstock 34 so that a new borehole can be drilled outside the casing, a starter mill (not shown) can be run in on a drill or work string. As the mill is rotated it slides down along the deflector surface 41 and cuts a pilot window opening through the wall of the casing 11. Then a combination of a window mill 105 and a "watermelon" mill 106 are connected in tandem and attached to the bit box 107 of a mud motor 108 as shown in FIG. 4. The motor 108 preferably is a Moineau-type device where a helical rotor revolves within a lobed stator in response to flow of drill fluids under pressure through it. The lower end of the rotor is connected to a beating mandrel and the bit box 107 by a drive shaft having universal joints at each end. The upper end of the motor 107 is connected to a string of drill collars 110 which provide weight on the milling bits 105, 106, and the upper end of the collar string 110 is connected to the lower end of the coiled tubing 17 (not shown) as previously described. The foregoing drilling tool assembly is run into the well 10 until the bits 105, 106 are just above the top of the whipstock 34, at which point mud circulation is started at a rate that achieves a desired bit rpm, for example about 220. Then the assembly is lowered and weight applied to cause the bits 105, 106 to mill out the window 112 to its full size opposite the inclined face 41 of the whipstock 34. After the window 112 has been milled cleanly through, drilling should be continued into the formation outside the casing 11 for about another 15 feet. Once this has been accomplished, the drilling tool assembly is pulled out of the well 10 and a larger and more powerful drill motor having rolling cutter bit, or a diamond bit, is used to drill the balance of the new borehole. Where the new borehole is to be drilled directionally by curving it along a selected path, a drilling motor having a bent housing that provides a bend point can be used to drill to the desired target.

It now will be recognized that new and improved methods and tool combinations have been disclosed for orienting and setting a whipstock in a well casing on a single trip of a running string. Certain changes or modifications may be made in the disclosed embodiment without departing from the inventive concepts involved. For example it is within the scope of this invention to run the mud motor 108 below the MWD tool and have a starter mill on the output shaft of the motor which is releasably connected to the whipstock 34 by the release device 33. In this case an additional round trip of the running string can be avoided. Thus it is the aim of the appended claims to cover all such changes and modifications falling within the true spirit and scope of the present invention.

What is claimed is:

1. A method of orienting a whipstock in a wellbore so that a window can be formed at a selected azimuth through the wall of a well casing in said wellbore, comprising the steps of: lowering a whipstock having a deflection surface and an anchor therefor into the wellbore on a running string, said anchor being disposed below said whipstock when said running string is disposed in said wellbore, said anchor including a shoe located at a bottom of said running string when said running string is disposed in said wellbore adapted for impacting an obstruction in said wellbore; measuring the azimuth of said deflection surface and transmitting signals representative thereof to the surface; adjusting the angular orientation of said deflection surface to obtain a selected azimuth; and then actuating said anchor to prevent movement of said whipstock, the step of actuating said anchor including the steps of impacting said shoe of said anchor against said obstruction in said wellbore and actuating said anchor in response to the impacting step.

2. The method of claim 1 wherein said measuring and transmitting step is carried out by instrumentalities that are releasably connected to said whipstock and anchor, and including the further step of releasing said instrumentalities from said whipstock and anchor after said adjusting and actuating steps have been performed; and retrieving said instrumentalities to the surface with said running string, leaving said whipstock and anchor in place.

3. The method of claim 2 including the further steps of lowering a milling device and a downhole motor for driving said milling device into the casing on a running string; and while guiding said milling device with said deflection surface, operating said motor to cause said milling device to form a window through the wall of said casing.

4. The method of claim 3 including the further steps of retrieving said motor and milling device from said casing; running a drill bit and a downhole motor into said casing and at least partially through said window; and operating said motor to cause said bit to drill a new borehole through the cement and earth formations outside said casing.

5. The method of claim 1 wherein said orientation adjusting step is carried out by rotating said whipstock through successive angular positions while monitoring said positions by said transmitted signals.

6. The method of claim 5 wherein said rotating step is carried out in response to changing in the rate of flow of drilling fluid through said running string.

7. The method of claim 6 wherein each changing step includes the steps of increasing and then decreasing said rate of flow, and in response to each increase and decrease, indexing said whipstock and anchor through a selected angle.

8. Apparatus for use in forming a window at a selected azimuth through the wall of a well casing in a borehole so that a new borehole can be drilled through earth formations outside the casing, comprising: whipstock and anchor means adapted to be lowered into the casing on a running string, said whipstock means having a deflection surface, said anchor means being disposed below said whipstock when said whipstock and anchor means is lowered into the borehole on said running string, said anchor means including impacting means located at a bottom of said running string when said running string is disposed in said borehole for impacting an obstruction in said borehole when said whipstock and anchor means is lowered into Said borehole; means for adjusting the angular orientation of said deflection surface downhole; means for measuring the orientation of said deflection surface to determine when said deflection surface has achieved a selected azimuth; downhole means for transmitting the measurements of said measuring means to the surface during said orientation; and means responsive to the impact by said impacting means of said anchor means against said obstruction in said borehole for setting said anchor means to fix the position of said whipstock means when the orientation of said deflection surface measured by the means for measuring has achieved said selected azimuth.

9. The apparatus of claim 8 wherein said adjusting means includes relatively rotatable members, said whipstock and anchor means being suspended from one of said members; and means for causing relative rotation of said one member through successive angles until said deflection face has said selected azimuth.

10. The apparatus of claim 9 wherein said rotation causing member means includes a sleeve member movable longitudinally relative to said members, and indexing means on said sleeve member and the other of said members for rotating said sleeve member and one member through a selected angle in response to relative longitudinal movement.

11. The apparatus of claim 10 further including flow restriction means on said sleeve member for causing movement in one longitudinal direction in response to an increase in the rate of drilling fluid flow through said restriction means; and resilient means for causing movement in the opposite longitudinal direction in response to a reduction in said rate of flow.

12. The apparatus of claim 8 further including means for releasably connecting said transmitting means to said whipstock and anchor means to enable said transmitting means, measuring means, and adjusting means to be removed from the well casing after setting of said anchor means.

13. The apparatus of claim 12 wherein said connecting means includes a shear member adapted to be disrupted in response to a predetermined longitudinal force.

14. Apparatus adapted for orienting a whipstock in a wellbore, comprising:

a running string adapted to be disposed in said wellbore, said running string including, a whipstock, an anchor adapted to set disposed below said whipstock on said running string when said running string is disposed in said wellbore, said anchor including a shoe located at a bottom of said running string when said running string is disposed in said wellbore adapted for impacting an obstruction in said wellbore, means for rotating said whipstock through a plurality of azimuths, means for measuring the plurality of azimuths of said whipstock during the rotation of said whipstock by said means for rotating, and anchor setting means responsive to an impact by said shoe of said anchor against said obstruction in said wellbore for setting said anchor when the azimuth of said whipstock measured by said means for measuring is approximately equal to a particular value.

15. The apparatus of claim 14, wherein said whipstock includes a deflection face, and said means for rotating comprises:

relatively rotatable members, said whipstock and said anchor being suspended from one of said members; and means for causing relative rotation of said one of said members through successive angles until the azimuth of said deflection face of said whipstock is approximately equal to said particular value.

16. The apparatus of claim 15, wherein said means for causing relative rotation comprises a sleeve member movable longitudinally relative to said members, and indexing means on said sleeve member and the other of said members for rotating said sleeve member and said one of said members through a selected angle in response to relative longitudinal movement.

17. The apparatus of claim 16, further including flow restriction means on said sleeve member for causing movement in one longitudinal direction in response to an increase in a rate of drilling flow through said restriction means; and resilient means for causing movement in the opposite longitudinal direction in response to a reduction in said rate of flow.

18. A method of orienting a whipstock in a wellbore, comprising the steps of:

locating an anchor having a shoe, a whipstock, a measuring apparatus, and a rotating apparatus on a running string;

lowering first said anchor of said running string into said wellbore, said shoe of said anchor being located at a bottom of said running string;

further lowering in any order said whipstock, said measuring apparatus, and said rotating apparatus of said running string into said wellbore;

rotating said whipstock through a plurality of azimuths using said rotating apparatus when said running string is disposed in said wellbore;

measuring said plurality of azimuths of said whipstock during the rotating step using said measuring apparatus; and impacting said shoe of said anchor against an obstruction in said wellbore when the azimuth of said whipstock measured by the measuring apparatus during the measuring step is approximately to a particular value, said anchor being set against a casing in said wellbore when said shoe impacts said obstruction in said wellbore, said whipstock being oriented in said wellbore when said anchor is set.

* * * * *